United States Patent [19]

Eames et al.

[11] 4,047,757

[45] Sept. 13, 1977

[54] SEATING STRUCTURES WITH FLEXIBLE BACKS

[76] Inventors: Loren W. Eames, 4233 N. Peck Road, El Monte, Calif. 91723; Joseph A. Berg, 22325 De Kalb Drive, Woodland Hills, Calif. 91364; Thomas W. McAllister, 19301 Caladero St., Tarzana, Calif. 91356

[21] Appl. No.: 682,583

[22] Filed: May 3, 1976

[51] Int. Cl.[2] ..... A47C 7/40

[52] U.S. Cl. ..... 297/230; 297/253; 297/460; 297/219

[58] Field of Search ..... 297/253, 231, 230, 352, 297/445, 457, 460, 294, 295, 296, DIG. 9, 312, 297, 298, 299, 306, 443, 451; D6/76, 77, 78

[56] References Cited

U.S. PATENT DOCUMENTS

| | | | |
|---|---|---|---|
| 582,144 | 5/1897 | Moore | 297/312 |
| 1,011,026 | 12/1911 | Carpenter | 297/460 |
| 2,280,231 | 4/1942 | Gulley | 297/352 |
| 2,663,359 | 12/1953 | Wood | 297/253 |
| 2,833,341 | 5/1958 | Bornstein | 297/253 X |
| 3,170,727 | 2/1965 | Peterson | 297/253 |
| 3,197,255 | 7/1965 | Caudill | 297/460 |
| 3,716,270 | 2/1973 | Frazier | 297/460 |
| 3,774,960 | 11/1973 | Blodee | 297/445 |
| 3,883,176 | 5/1975 | Morton | 297/457 |
| D. 166,397 | 4/1952 | Komai | 297/457 X |

*Primary Examiner*—Francis K. Zugel
*Attorney, Agent, or Firm*—William P. Green

[57] ABSTRACT

A seating unit with a flexible seat back having an upper portion separated into two halves positioned to support a user's back at opposite sides of his spine, and with these halves being mounted for resiliently resisted rearward deflection relative to one another in order to accommodate movement of the user's body, and with a slit or the like being provided at the center of the back between these halves to enable projection of the user's spine rearwardly beyond adjacent portions of the user's back for optimum comfort at all times. The back structure may be connected to a generally horizontal seat element, which may be bifurcated to have two relatively movable forwardly projecting portions. The device may also have an anchoring portion for detachable connection to a cushion of an upholstered seat on which the unit is to be used.

18 Claims, 10 Drawing Figures

SEATING STRUCTURES WITH FLEXIBLE BACKS

BACKGROUND OF THE INVENTION

This invention relates to improved seating structures of a type having portions which are shiftable in certain respects in correspondence with the movements of a user's body, to enhance the user's comfort.

Most conventional types of seat backs with which we are familiar have a tendency to become very uncomfortable after a user has been in the seat for any substantial period of time. This is true even in the case of upholstered type seats, which though cushioned for the purpose of providing a soft and yielding support to the user's back, are not capable of giving as effective support as would be desired when the user shifts his body slightly to different positions over a period of time. Further, many of these prior seats are, in any body position, very uncomfortable to the spine, by reason of their construction in a manner causing exertion of a substantial portion of the back supporting force directly against the bones of the spine, or by reason of their construction in such a non-supportive manner as to allow the spine to overly relax in a curved condition and rapidly develop fatigue.

SUMMARY OF THE INVENTION

The present invention provides a unique seat back arrangement which includes two back elements positioned to support the back of the user along opposite sides of his spine, with these elements being carried by a common mounting structure connected to lower portions of the two elements and yieldingly mounting them for resiliently resisted rearward deflection relative to the mounting structure and relative to one another in correspondence with shifting movements of different portions of a user's body. These two elements are free of attachment to one another at their upper ends, and along inner edge portions of the two elements as those portions extend downwardly along the spine. These inner edge portions of the two elements are so shaped as to leave the user's spine itself essentially unsupported, so that the spine may project rearwardly slightly beyond adjacent portions of the user's back, and thereby avoid exertion of the above discussed unwanted forces directly against the spine. This result is preferably achieved by providing the seat back structure with a slit extending downwardly between the two back supporting elements, and dimensioned to receive the spine therebetween.

The seating device of the invention may be a portable unit which is positionable on an upholstered seat or chair, such as for example an automobile seat, in which event the mentioned mounting structure for the two elements may include an anchoring projection adapted to extend into a space between two cushions of the upholstered seat and retain the portable structure in a desired position relative thereto. Also, in certain instances the two back supporting elements or portions of the device may have cushioning sleeves received thereabout for further improving the comfort of the back support.

The lower position of the back structure may be connected to a seat proper, which projects forwardly and is desirable bifurcated to form two forwardly projecting halves which are relatively vertically deflectable to accomodate upward and downward movements of opposite sides of the user's body.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
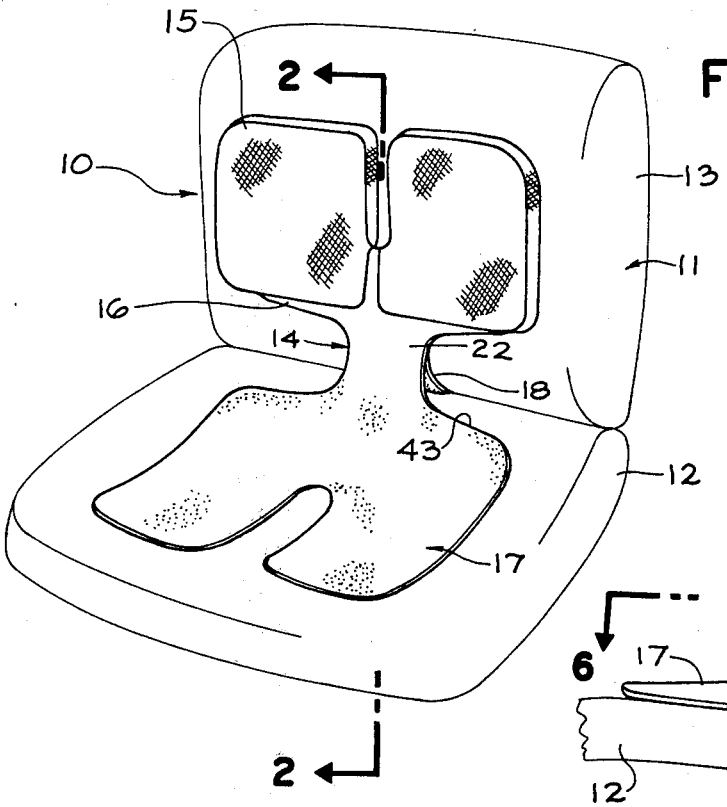
FIG. 1 is a perspective view of a seat device embodying the invention, shown positioned on an automobile seat.

Referring first to FIG. 1, we have illustrated at 10 in those FIGURES a portable seating unit which is illustrated as applied to an upholstered seat 11. This seat 11 may typically be an automobile seat, having a generally horizontal seat cushion 12 and an upwardly projecting back cushion 13.

The unit 10 includes a preferably one piece body 14, which may be molded integrally from an appropriate resinous plastic material, and carry two cushion sleeves 15. the material of body 14 is essentially stiff to afford substantial support to the different portions of the user's body, but has some resilient deformability as will be brought out as the description progresses. This body forms an upwardly projecting back structure 16, a generally horizontal forwardly projecting seat structure 17, and a rearwardly extending anchoring projection 18 merging essentially with the juncture of the back 16 and seat 17. As seen best in FIG. 2, this anchoring projection initially extends downwardly at 19, and then curves rearwardly and ultimately upwardly to a location 20, to have an essentially hook-shaped vertical cross sectional configuration defining an upwardly facing or upwardly concave recess 21 within which the lower edge portion of upholstered seat cushion 13 is received to effectively retain unit 10 in the FIGS. 1 and 2 position relative to the upholstered seat. The projection 18 desirably has the cross section of FIG. 2 entirely across the width of that projection, transversely of the seat.

The seat back portion 16 of body 14 may be inclined slightly rearwardly as it extends upwardly along the front of the inclined forward surface 122 of the upholstered cushion 13. In extending upwardly, the seat back portion 16 has a first relatively narrow supporting post portion 22 which is symmetical with respect to a central vertical front to rear plane 23 of the seating device 10. At the upper end of post 22, the seat portion 16 of body 14 carries a portion 24 of a considerably increased width *w*, desirably at least several times the width l of post 22, with this upper wide portion of the body 14 containing a slit 25 extending downwardly from the top of body 14 to a location 26. Slit 25 is centered with respect to the previously mentioned vertical central front to rear plane 23, and is of a width *t* just great enough to easily accomodate the spine of a user in a relation avoiding direct exertion of supporting force against the spine. More particularly, the width *t* may be between about 1 and 2 inches.

The slit 25 thus divides the upper portion of the seat back structure into two halves 28 and 29, each of which is the mirror image of the other, and which are defined by lower generally horizontal edges 30, outer essentially vertical edges 31, upper essentially horizontal edges 32, and spaced parallel essentially vertical inner edges 27 of the two halves defining slit 25. Since the user's spine is intended to be located at essentially the vertical central plane 23, the two halves 28 and 29 of the upper portion of the back structure function essentially as two laterally spaced elements for engaging the user's back at opposite sides of the spine respectively, to support the back at those two locations somewhat independently and in a relation enabling accomodation of the back structure to changes in position of the user's body. The resinous plastic or other material from which the body 14 of the device is formed has sufficient resilient deformability to enable both of the seat back halves 28 and 29 to be bent rearwardly through a substantial distance by the user's body, either together as to the broken line positions represented at 28' and 29' in FIG. 5 (when the same force is exerted against both of the elements 28 and 29), or separately and relative to one another as represented by the position 128 of element 28 in FIG. 5 (greater force exerted against one of the elements 28 or 29 than the other). These different types of movement of the two halves 28 and 29 are rendered possible primarily by bending and/or twisting of the material of the seat back at its narrow mounting post portion 22 and/or at its narrow neck portions (dimension *x* in FIG. 3) which connect elements 28 and 29 to post 22 and to one another. At the same time, the stiffness of these portions of the back structure is sufficient to yieldingly resist deflection of each of the elements 28 and 29 with a substantial force giving a very effective resilient support to each side of the user's back. Preferably, the two halves or elements 28 and 29 have their lower edges 30 positioned at or just slightly above the level of a plane 33 (FIG. 3) which is at the user's waistline. As will be apparent from the drawings, the width dimention l of mounting post portion 22 of the device, and the widths *x* of the two connector portions which attach elements 28 and 29 to post 22, are all desirably several times as great as the minimum front to rear thicknesses of each of the portions 22, 28 and 29, as well as the minimum front to rear thicknesses at the locations of dimensions *x.*

Figure 3:
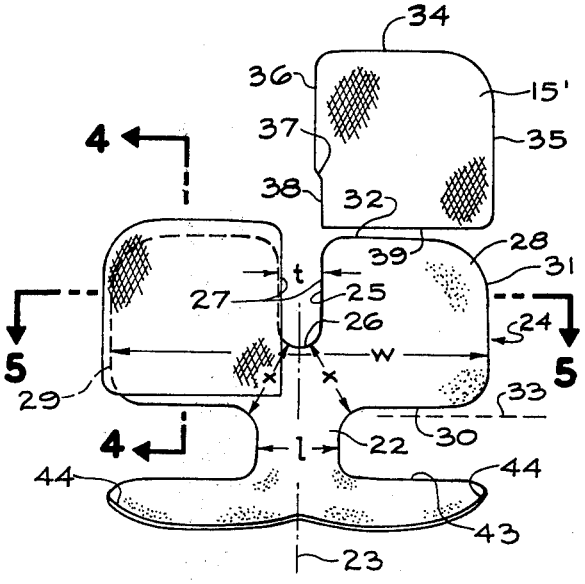
FIG. 3 is a front elevational view taken on line 3—3 of FIG. 2.

The two cushion sleeves 15 may be formed essentially as inverted sacks, which can be removably slipped downwardly about the two halves 28 and 29 from a position such as that illustrated at 15' in FIG. 3. More particularly, each of these sleeves may be formed from two front and rear pieces of fabric stitched together along their upper edges 34, outer edges 35, and inner edges 36 down to a location 37, with the inner edges being open at 38 beneath the location 37, and with the bottom edges 39 also being open. Each cushion 15 may thus be slipped downwardly to a location at which the point 37 is just above the lower extremity 26 of slit 25. A layer of padding 39 is provided within each of the cushion sleeves, and is appropriately secured thereto, to be received at the front side of a corresponding one of the back supporting halves 28 or 29 to cushion the support afforded thereby. Alternatively, cushioning pads can of course be secured directly to the front of halves 28 and 29, as by means of velcro fasteners or the like.

Figure 4:
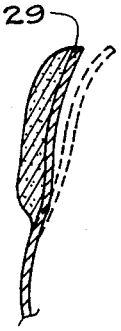
FIG. 4 is a vertical section taken on line 4—4 of FIG. 3.
Figure 5:
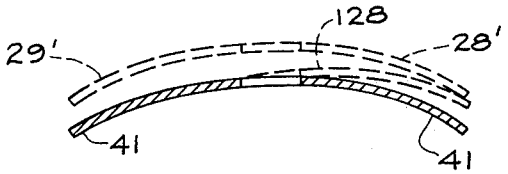
FIG. 5 is a horizontal section taken on line 5—5 of FIG. 3.

As seen in FIGS. 4 and 5, the two back supporting halves or elements 28 and 29 may be contoured to effectively support the back of a user, preferably by curving the opposite side edge portions 41 slightly forwardly as seen in FIG. 5, and by curving the elements slightly rearwardly as they advance upwardly, as seen in FIG. 4.

Figure 6:
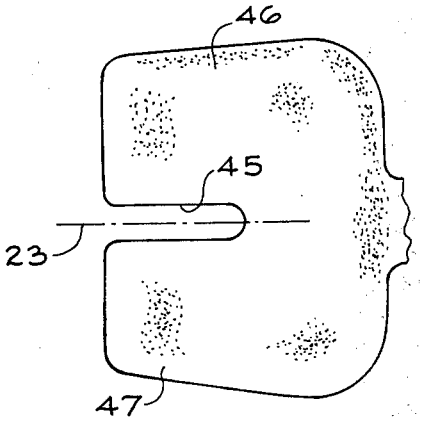
FIG. 6 is a fragmentary plan view taken on line 6—6 of FIG. 2.

The seat portion 17 of the device 10 is connected integrally at its back edge to the upstanding post portion 22 of the back structure, and projects forwardly along the top of seat cushion 12. Seat portion 17 is contoured to comfortably support a user's body, as by curving the rear edge of this seat portion upwardly at 43, and similarly curving the opposite side edges upwardly at 44. A slit 45 (FIG. 6), which is symmetrical with respect to the central vertical plane 23, divides the forward portion of the seat structure into two halves 46 and 47, which are mirror images of one another, and which support the two halves respectively of the user's body. These halves 46 and 47 are deflectable downwardly relative to one another, against the resilience of the material forming the seat.

When the seat device 10 is in use, whenever the user tends to become fatigued in one body position he unconsciously shifts his weight very slightly with respect to the seat device 10 to a more comfortable position, and in doing so may bend one of the seat back halves or elements 28 or 29 slightly rearwardly relative to the other element and relative to post 22 and seat 17, and may similarly deflect one of the halves 46 or 47 of the bifurcated seat 17 slightly downwardly relative to the other half, but with these movements being yieldingly resisted by the inherent resilience of the material of which body 14 is formed. Frequent relatively minute changes in position of this type keep the user comfortable over very long periods of time. Further, the support afforded to the back by elements 28 and 29 and their cushion sleeves 15 is at optimum support locations, just above the waistline and at opposite sides of the spine. The spine itself, just above the waistline location, is free to project slightly rearwardly into slit 25 between elements 28 and 29, that is, the spine may project rearwardly slightly beyond the laterally adjacent portions of the user's back which are supported by elements 28 and 29 along opposite sides of slit 25. In this way, the discomfort which results when the spine itself is directly supported against rearward movement is avoided.

Figure 2:
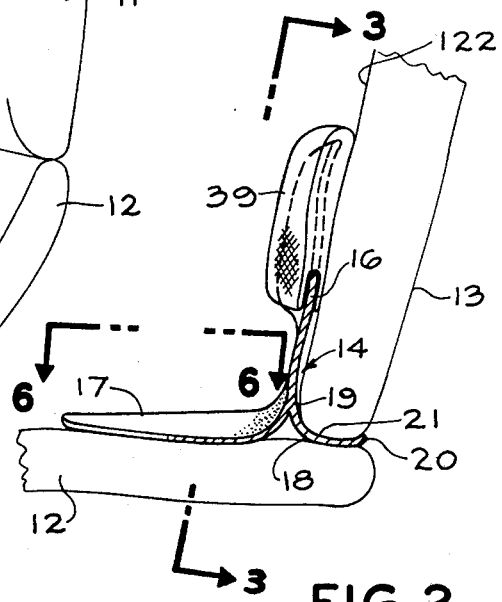
FIG. 2 is a vertical section taken on line 2—2 of FIG. 1.
Figure 7A:
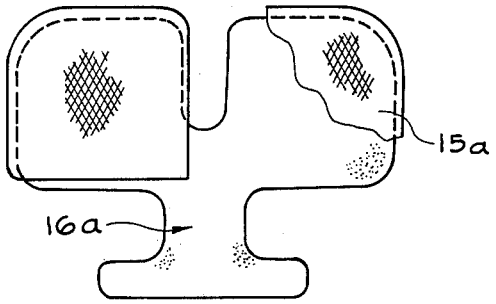
FIG. 7*a* is a front elevational view of the FIG. 7 device.
Figure 7:
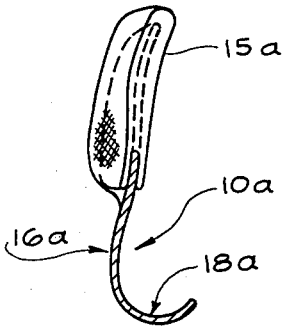
FIG. 7 is a view similar to FIG. 2, but showing a variational form of the invention.

FIGS. 7 and 7*a* are views similar to FIGS. 2 and 3 respectively, but showing a variational unit 10*a* which is identical to that of FIGS. 1 to 6 except that the seat portion 17 of the device has been omitted. This leaves only a back structure 16*a* corresponding to that illustrated at 16 in the first form of the invention, integrally carrying at its lower end an anchoring portion 18*a* at its lower end which may be wider than supporting post 22*a* as shown. Back structure 16*a* may or may not have two cushions 15*a* corresponding to those illustrated at 15 in FIG. 1. The device of FIGS. 7 and 7*a* may thus be applied to an automobile seat or other upholstered seat and be utilized for more effectively supporting the back of a user, and allowing frequent slight shifting movements of the back while at all times maintaining effective support thereof, with the device being held in place by the anchoring portion 18*a* positioned as illustrated in FIG. 2.

Figure 8:
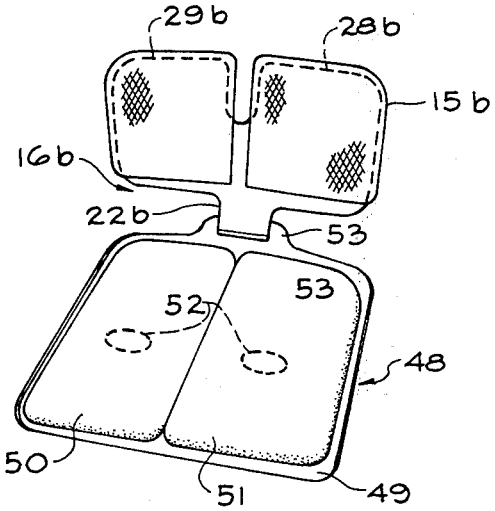
FIG. 8 is a perspective view showing a further variational arrangement.
Figure 9:
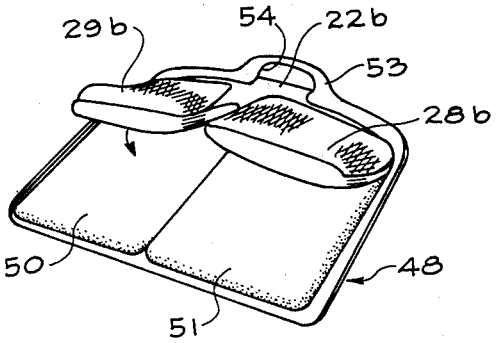
FIG. 9 shows the FIG. 8 device as it is being folded to a more portable condition.

FIGS. 8 and 9 show another arrangement in which a back structure 16*b* identical with that described at 16 in FIGS. 1 to 6, and preferably carrying cushioning sleeves 15*b* on its two upper halves 28*b* and 29*b*, is connected at the lower end of its mounting post portion 22*b* (corresponding to portion 22 of FIGS. 1 to 6) to the rear edge of a seat assembly 48. This seat assembly 48 may be similar to the arrangement illustrated in U.S. Pat. No. 3,749,442, and more particularly may include a rigid horizontal base plate 49 which rests on a supporting upholstered cushion or other support, and which movably carries two generally horizontal seat sections 50 and 51 for engaging and supporting opposite sides of a user's body. These two sections 50 and 51 may be appropriately cushioned, and are connected at their undersides to base 49 by universal connections 52 which allow each of the sections 50 and 51 to have independent slight universal pivotal movement relative to base 49 for supporting the user's body in different positions. At its rear edge, base 49 of the seat assembly is connected to the lower portion of back structure 16*b* by a horizontal transverse hinge 53, which mounts the back for swinging movement forwardly from the position of FIG. 8 through the position of FIG. 9 to a position essentially overlying and parallel to seat assembly 48, in which folded condition the entire assembly is very easily portable. In its upstanding active position, the seat back 16*b* may be supported against further rearward swinging movement by engagement of post 22*b* with an upwardly extending rear flange portion 53 of base 49, which flange portion may contain a hand hole aperture 54 providing a handle by which the assembly in folded condition may be carried.

When this arrangement of FIGS. 8 and 9 is in use, the seat structure provides optimum vertical support to the user's body, with freedom for shifting movement to different positions, while the back structure 16*b* provides support to the user's back, again with freedom for shifting movement as discussed in connection with the first form of the present invention.

While certain specific embodiments of the present invention have been disclosed as typical, the invention is of course not limited to these particular forms, but rather is applicable broadly to all such variations as fall within the scope of the appended claims.

We claim:

1. A seating device comprising:

a seat back body which has sufficient stiffness to support the back of a user but is rearwardly flexible to conform to movements of the user's back;

said body having a lower mounting portion extending upwardly at the center of the user's back, and having two upper portions both carried movably by said lower mounting portion and extending upwardly and laterally outwardly therefrom in opposite directions respectively to support the back of a user at opposite sides of the spine;

said two upper portions of said body having a combined overall width substantially greater than the maximum width of said lower mounting portion between two opposite side edges thereof;

said body containing an upwardly opening slit which extends downwardly into the body from an upper end thereof, at a laterally central location and between said two upper portions of the body, and which terminates downwardly at a lower end of the slit above said lower mounting portion of the body;

said body having two flexible connector portions joining said two upper portions of the body respectively with said lower mounting portion thereof and extending between said lower end of said slit and the upper extremities of said opposite side edges of said lower mounting portion;

said device being constructed at the location of said slit to avoid support of a user's back along the spine, from the upper end of said slit downwardly to approximately said lower end of the slit, and to thereby allow the spine to project rearwardly farther than do laterally adjacent portions of the user's back which are supported by said two upper portions of said body.

2. A seating device as recited in claim 1, in which the minimum horizontal width of said lower mounting portion of the body as viewed from the front is several times as great as the minimum front to rear thickness of said lower mounting portion of the body.

3. A seating device as recited in claim 1, in which the minimum effective widths, as viewed from the front, of said two connector portions, in extending between the lower end of said slit and the upper extremities of said side edges of said mounting portion of the body, are both several times as great as the minimum front to rear thickness of said connector portions.

4. A seating device as recited in claim 1, in which the minimum horizontal width of said lower mounting portion of the body as viewed from the front, and the minimum effective front view widths of said two connector portions in extending between the lower end of said slit and the upper extremities of said edges of said mounting portion of the body, all are several times as great as the minimum front to rear thickness of said lower mounting portion of the body.

5. A seating device as recited in claim 1, in which said opposite side edges of said lower mounting portion of the body are spaced apart a distance greater than the width of said slit, and the minimum widths of said connector portions extend along lines which are inclined downwardly and outwardly from the lower end of said slit to said upper extremities of said opposite side edges of the lower mounting portion of the body.

6. A seating device as recited in claim 5, in which the minimum horizontal width of said lower mounting portion of the body as viewed from the front is several times as great as the minimum front to rear thickness of said lower mounting portion of the body.

7. A seating device as recited in claim 6, in which the minimum width of said connector portions in extending at an inclination downwardly and outwardly between the lower end of said slit and the upper extremities of said side edges of said mounting portion of the body are both several times as great as the minimum front to rear thickness of said connector portions.

8. A seating device as recited in claim 1, in which said slit has a horizontal width of at least about one inch.

9. A seating device as recited in claim 1, including anchoring means at the lower end of said lower portion of said body and adapted to project into a space between an upholstered seat cushion and upholstered seat back of a chair or the like to anchor said device thereto.

10. A seating device as recited in claim 1, including an an anchoring projection connected to a lower end of said mounting portion of said body and adapted to be received beneath the lower edge of an upholstered seat cushion and having an upwardly concave hook shape for receiving said lower edge of the cushion to hold said device in fixed position relative thereto.

11. A seating device as recited in claim 1, including a seat element connected at its rear edge to a lower end of said lower mounting portion of said body and projecting forwardly therefrom.

12. A seating device as recited in claim 1, including a seat structure connected to said lower portion of said seat back body and projecting forwardly therefrom and bifurcated to form two forwardly projecting seat halves free for relative upward and downward movement in correspondence with movements of a user's body.

13. A seating device as recited in claim 1, including a seat structure projecting forwardly of said seat back body, and hinge means connecting said seat back body for swinging movement relative to said seat structure between an upwardly projecting active position and a forwardly swung inactive position of extension across the upper side of said seat structure.

14. A seating device as recited in claim 1, including a seat structure connected at a rear edge thereof to said seat back body and projecting forwardly therefrom and bifurcated to form two forwardly projecting seat halves free for relative upward and downward movement in correspondence with the movements of a user's body, and an anchoring projection connected to said seat back body and said seat structure and projecting rearwardly at the juncture thereof and adapted to be received between an upholstered seat cushion and an upholstered seat back to secure said device thereto.

15. A seating device as recited in claim 14, including two cushioning sleeves removably receivable about said two upper portions of said body and cushioning the forward sides thereof.

16. A seating device as recited in claim 1, including two cushioning sleeves removably receivable about said two upper portions of said body and cushioning the forward sides thereof.

17. A seating device as recited in claim 1, in which said seat back body is an integral one-piece body having a front to rear thickness dimension which is very small as compared with the widths of said mounting portion and said upper portions and said connector portions of the body as viewed from the front.

18. A seating device as recited in claim 17, in which said one-piece body has an integral anchoring projection at the lower end of said mounting portion thereof and which curves rearwardly and then upwardly for anchoring engagement with the lower end of an upholstered seat cushion, there being two cushioned sleeves received downwardly over and about said two upper portions of said body and adapted to cushion the forward sides thereof.

* * * * *